US009708760B2

(12) United States Patent
Luo et al.

(10) Patent No.: US 9,708,760 B2
(45) Date of Patent: Jul. 18, 2017

(54) ESTERIFIED CELLULOSE PULP COMPOSITIONS AND RELATED METHODS

(71) Applicant: International Paper Company, Memphis, TN (US)

(72) Inventors: Mengkui Luo, Auburn, WA (US); Angela Dodd, Seattle, WA (US); Hugh West, Seattle, WA (US); Amar Neogi, Kenmore, WA (US); Karen D. Brogan, Federal Way, WA (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 214 days.

(21) Appl. No.: 14/320,325

(22) Filed: Jun. 30, 2014

(65) Prior Publication Data

US 2015/0376836 A1 Dec. 31, 2015

(51) Int. Cl.

| | |
|---|---|
| ***D21C 9/00*** | (2006.01) |
| ***D21H 17/27*** | (2006.01) |
| ***D21H 17/07*** | (2006.01) |
| ***D21H 13/06*** | (2006.01) |
| ***D21H 17/15*** | (2006.01) |

(52) U.S. Cl.

CPC ..... *D21C 9/005* (2013.01); *D21H 13/06* (2013.01); *D21H 17/07* (2013.01); *D21H 17/15* (2013.01); *D21H 17/27* (2013.01)

(58) Field of Classification Search

CPC ..... D21H 17/07; D21H 17/15; D21C 9/005

See application file for complete search history.

(56) References Cited

U.S. PATENT DOCUMENTS

| | | | |
|---|---|---|---|
| 6,824,599 | B2 | 11/2004 | Swatloski |
| 7,749,318 | B2 | 7/2010 | Maase |
| 7,754,002 | B2 | 7/2010 | Maase |
| 7,828,936 | B2 | 11/2010 | Luo |
| 7,919,631 | B2 | 4/2011 | Buchanan |
| 8,044,120 | B2 | 10/2011 | D Angola |
| 8,067,488 | B2 | 11/2011 | Buchanan |
| 2011/0046365 | A1 | 2/2011 | Mikkonen et al. |

OTHER PUBLICATIONS

Barthel et al., Acylation and carbanilation of cellulose in ionic liquids, Dec. 2005, Green Chemistry, 8, 301-306.*

Liu et al., Chemical Modification of Cellulose with Succinic Anhydride in Ionic Liquid with or without Catalysts, Feb. 2011, InTech.*

* cited by examiner

*Primary Examiner* — Anthony Calandra

(74) *Attorney, Agent, or Firm* — Christensen O'Connor Johnson Kindness PLLC

(57) ABSTRACT

Esterified cellulose pulp compositions produced in high yield from commercially available wood pulp sources, methods for making the esterified cellulose pulp compositions, and articles prepared from the esterified cellulose pulp compositions.

15 Claims, 2 Drawing Sheets

ESTERIFIED CELLULOSE PULP COMPOSITIONS AND RELATED METHODS

TECHNICAL FIELD

The present disclosure relates to methods for forming esterified cellulose pulp compositions and the products from such methods.

BACKGROUND

Cellulose esters of organic acids are useful for a variety of purposes. The most common among the cellulose esters is cellulose acetate, which is used extensively in textile and polymer industries, among others. Specific applications include cigarette tow, cellulose films, and packaging, particularly food packaging.

Cellulose esters are advantageous due in part to the renewable nature of the cellulose, the starting material for all cellulose esters. Although cellulose acetate has been produced from both cotton and wood pulp, wood pulp is the dominant cellulose source due to economic factors.

Typically, cellulose ester in general, and cellulose acetate in particular, is produced from high purity pulp—that is, cellulose pulp having an alpha cellulose content greater than about 95%. The demand for high purity pulp stems from the desired properties of the products from which cellulose esters are made. These desired properties include, for example, optical transparency and colorlessness. However, significant processing of wood is required to provide high quality cellulose pulp suitable for cellulose ester end products. This processing typically includes the removal of hemicellulose and lignin. The hemicellulose component of wood is removed by chemical treatment, pre- or post-pulping, and lignin is removed by chemical pulping and bleaching. While the result of such treatment is high quality pulp, the actual pulp yield is low due to the extensive processing. Coupled with the low yield and chemical treatments, as well as capital and operating costs, high quality pulp is expensive.

Accordingly, there exists a need for high quality cellulose esters produced in high yield from low quality cellulose sources, such as high hemicellulose content pulp (e.g., pulp having a hemicellulose greater than about 5 percent by weight based on the total weight of the pulp).

Processes for producing cellulose esters can be categorized as heterogeneous or homogenous.

In heterogeneous processes, wood pulp is treated with an esterifying solution. In such processes, the esterified product becomes dissolved in the solution, which can be readily separated from the insoluble un-esterified pulp, and ultimately recovered from the solution. This type of process can be manipulated to reduce the hemicellulose content and enhance the quality of the product cellulose esters (e.g., by exploiting the preferential esterification of hemicellulose and separating esterified hemicellulose from cellulose that is not (yet) esterified, by conducting the esterification under highly acidic conditions such that hemicellulose content is significantly reduced, as in chemical pulping processes, etc.). However, although these processes can provide suitable cellulose esters, they suffer from reduced yield and additional processing steps.

In homogeneous processes, wood pulp is dissolved in a liquid (e.g., an ionic liquid) and by reaction with an esterifying agent that is also in solution, esterification occurs in solution. Due to all reactants being in solution (rather than the esterifying agent being in solution and the pulp being undissolved and not in solution), homogeneous processes tend to afford greater control and provide more consistent results, as compared with heterogeneous processes. These processes also benefit from starting with high quality pulp (i.e., highly processed pulp containing little to no lignin or hemicellulose). Ionic liquid processes for producing esterified cellulose are described in U.S. Pat. No. 8,067,488.

Therefore, in addition to advantageous (e.g., comparably better handling properties, less color, etc.) cellulose esters produced from high cost, high quality cellulose pulps and the efforts noted above with regard to attempts to produce high quality cellulose esters from lower quality pulp, a need exists for the production of suitable cellulose esters from relatively lower cost, commercially available wood pulp. The present disclosure addresses this need and provides further related advantages.

SUMMARY

In general, the present disclosure relates to esterified cellulose pulp compositions produced in high yield from commercially available wood pulp sources by combining a cellulose pulp with an ionic liquid, adding an esterification agent and/or a catalyst to the solution, then isolating esterified cellulose from the reaction mixture.

Thus, in one aspect, the present invention provides esterified cellulose pulp compositions having a degree of substitution from about 0.1 to about 3.0 and a hemicellulose content from about 2.5 to about 20 percent by weight based on the total weight of the composition. In some embodiments, the esterified cellulose pulp compositions also have sulfur content lower than about 45 ppm, nitrogen content lower than about 0.2% by weight, and/or intrinsic viscosity from about 0.7 to about 3.0 dL/g. In some embodiments, the esterified cellulose pulp compositions are $C_2$ to $C_{12}$ alkyl esterified.

In another aspect, the present invention provides methods of making esterified cellulose pulp compositions, which include combining an ionic liquid with a cellulose pulp having an alpha cellulose content from 70 to 90 wt %, a hemicellulose content from about 5 to about 20% by weight, and a degree of polymerization from about 150 to about 1,000, to produce a cellulose solution; adding an esterification agent, and optionally a catalyst, to the cellulose solution; and isolating an esterified cellulose pulp composition from the resulting reaction mixture. In some methods, the esterified cellulose pulp composition is isolated by precipitating, followed by pulsing, blending, and/or grinding the precipitated composition in washing liquids. In some methods, the esterified cellulose pulp composition is washed and/or optionally bleached. A variety of ionic liquids, co-solvents, catalysts, and combinations thereof, are suitable for use in methods in accordance with the invention.

DETAILED DESCRIPTION

Figure 1:
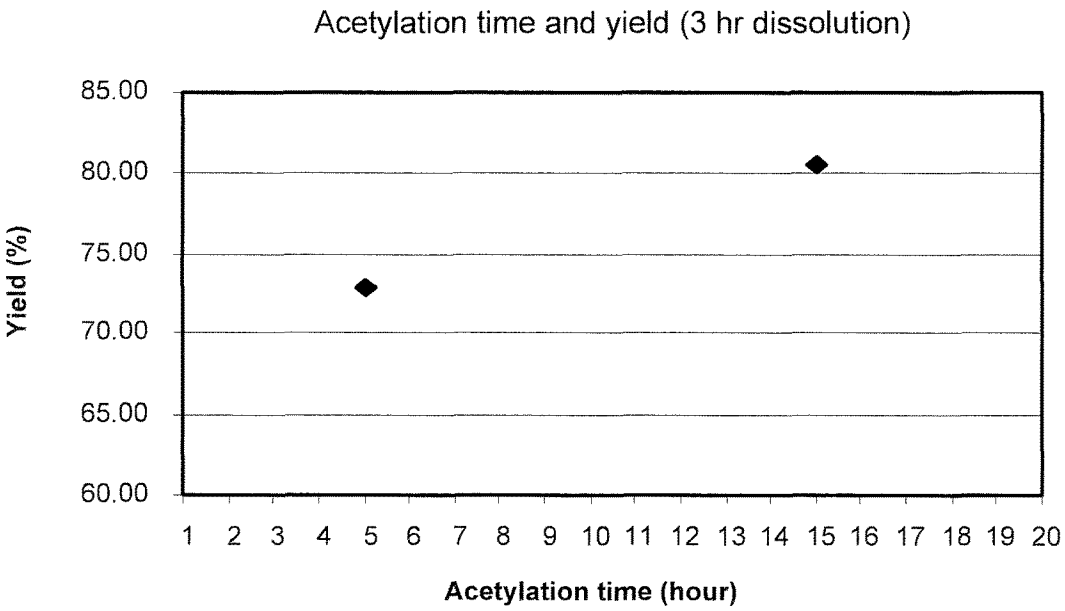
FIG. 1 is a graph illustrating anhydride conversion yield as a function of acetylation time for a representative esterified cellulose pulp, cellulose acetate, with a dissolution time of 3 hours and acetic anhydride addition time of 0.25 hour.

The present invention provides esterified cellulose pulp compositions produced in high yield from commercially available wood pulp sources. The cellulose esters of the invention are suitable for a variety of uses including those conventionally prepared from cellulose acetate. Methods for making the esterified cellulose pulp compositions and articles prepared from the esterified cellulose pulp compositions are also provided.

Esterified Cellulose Pulp Compositions

In one aspect, the invention provides an esterified cellulose pulp composition having a degree of substitution from about 0.1 to about 3.0 and a hemicellulose content from about 2.5 to about 20 percent by weight based on the total weight of the composition.

The term "esterified cellulose pulp composition" refers to the product formed by esterification of a cellulose-based pulp. The cellulose-based pulp is a chemical pulp prepared by, for example, the kraft pulp process, the sulfite process, a prehydrolyzed kraft process, or their various modifications. As a chemical pulp, the cellulose-based pulp is essentially delignified (i.e., having a lignin content less than about 0.5% by weight based on the total weight of the pulp). Like the cellulose-based pulp, the esterified cellulose pulp composition is similarly essentially free of lignin (e.g., having a lignin content less than about 0.5% by weight based on the total weight of the composition). The cellulose-based pulp includes hemicellulose, and because the esterification processes described herein substantially preserve the hemicellulose content of the pulp, the esterified cellulose pulp composition also includes esterified hemicellulose.

The cellulose pulp composition of the invention is an esterified composition and has a degree of substitution (DS) from about 0.1 to about 3.0. The degree of substitution is the degree of ester substitution of the repeating anhydroglucose units of cellulose and hemicellulose (xylan and mannan) repeating unit. Each repeating unit (excluding end units) has a maximum number of three (3) esterification sites (i.e., three esterifiable hydroxyl groups). Therefore, the maximum degree of substitution is 3.0 (i.e., completely esterified). A degree of substitution of 1.0 corresponds to an average of one ester group per repeating unit (such as anhydroglucose in cellulose). A degree of substitution of 0.1 corresponds to an average of one ester group per ten (10) repeating units.

In certain embodiments, the esterified cellulose pulp composition has a degree of substitution from about 1.0 to about 2.7. In other embodiments, the esterified cellulose pulp composition has a degree of substitution from about 2.0 to about 2.5.

In certain embodiments, the esterified cellulose pulp composition is a $C_2$ to $C_{12}$ alkyl esterified cellulose pulp composition. As used herein, the term "$C_2$ to $C_{12}$ alkyl esterified cellulose pulp composition" refers to number of carbons imparted to the composition by the esterifying agent. For example, esterified cellulose pulp compositions that are acetates ($CH_3C(=O)O—$) are $C_2$ alkyl esterified, propionates ($CH_3CH_2C(=O)O—$) are $C_3$ alkyl esterified, and hexanoates ($CH_3(CH_2)_4C(=O)O—$) are $C_6$ alkyl esterified. Representative alkyl esterified compositions of the invention include acetate, propionate, butanoate, hexanoate, and laurate cellulose pulp compositions. In certain embodiments, the esterified cellulose pulp composition is an acetate. In other embodiments, the esterified cellulose pulp composition is a propionate.

In other embodiments, the esterified cellulose pulp composition is a mixed esterified cellulose pulp composition. The mixed esterified cellulose pulp composition is a mixed $C_2$ to $C_{12}$ alkyl esterified cellulose pulp composition. As used herein, the term "mixed" refers to a composition that includes two or more different esters prepared by treatment with two or more different esterifying agents. An exemplary mixed $C_2$ to $C_{12}$ alkyl esterified cellulose pulp composition is a $C_2/C_3$ (acetate/propionate) composition, prepared by treatment with an acetate-forming esterifying agent and a propionate-forming esterifying agent. In certain embodiments, the esterified cellulose pulp composition is an acetate/propionate. In other embodiments, the esterified cellulose pulp composition is an acetate/butanoate.

Representative cellulose-based pulps useful for making the esterified cellulose pulp composition have a hemicellulose content from about 5 to about 20% by weight based on the total weight of the pulp. The esterified cellulose pulp composition has a hemicellulose content from about 2.5 to about 20% by weight based on the total weight of the composition.

While cellulose is comprised of glucose repeating units, hemicellulose includes predominantly xylan and mannan, which are polymers of xylose and mannose, respectively. Hemicellulose content (i.e., defined herein as the sum of mannan and xylan content) can be measured using a Weyerhaeuser sugar analysis test, as described in U.S. Pat. No. 7,390,566, incorporated herein by reference in its entirety. The hemicellulose test is based on TAPPI T249-cm00 with analysis by Dionex ion chromatography.

For the compositions of the invention, the hemicellulose content is calculated based on total weight of the esterified composition, and therefore takes into account the increased weight of the pulp as it is esterified as well as the slight loss of hemicellulose during the esterification process (such as may be seen at lower pH, higher temperature, and/or slower reaction time). As such, hemicellulose content varies based on the nature of the ester (e.g., acetate adds less weight than propionate, per unit), degree of substitution (DS), hemicelluloses loss, etc. For example, for cellulose acetates, at DS=0.1, hemicellulose content may range from 4.85 to 19.39% by weight based on the total weight of the composition; at DS=0.5, hemicellulose content may range from 4.40 to 17.58% by weight based on the total weight of the composition; at DS=1.0, hemicellulose content may range from 3.94 to 15.76% by weight based on the total weight of the composition; at DS=2.0, hemicellulose content may range from 3.25 to 13.01% by weight based on the total weight of the composition; and at DS=3.0, hemicellulose content may range from 2.77 to 11.07% by weight based on the total weight of the composition. For higher esters (e.g., propionate, butanoate, pentanoate, hexanoate) the range is lower at same DS.

In certain embodiments, the esterified cellulose pulp composition has a hemicellulose content from about 3.5 to about 10% by weight based on the total weight of the composition.

In certain embodiments, the esterified cellulose pulp composition has a xylan content from about 1 to about 7% by weight based on the total weight of the composition. In other embodiments, the esterified cellulose pulp composition has a xylan content from about 2.5 to about 5% by weight based on the total weight of the composition.

In certain embodiments, the esterified cellulose pulp composition has an intrinsic viscosity from 0.7 to 3.0 dL/g. In some embodiments, the intrinsic viscosity is from 1.0 to 2.50 dL/g. Intrinsic viscosity is determined by ASTM D-817 in N-methylpyrrolidone at 25° C.

The esterified cellulose pulp compositions of the invention can be distinguished from cellulose esters prepared by conventional esterification processes not only by hemicellulose content, but also by comparatively low sulfur content and/or low nitrogen content. Conventional esterification processes that include sulfuric acid treatment (e.g, as a catalyst) impart sulfur (e.g., in the form of cellulose sulfate) to the product cellulose esters. Sulfate groups in cellulose acetate can be removed with controlled hydrolysis, but cannot be removed completely with water. Similarly, processes that employ nitrogen-containing ionic liquids impart nitrogen to the product cellulose esters. In some methods of the invention, ionic liquids are used without catalyst or sulfur-containing catalyst to form sulfate; the product esterified cellulose pulp composition is processed extensively to reduce sulfur and nitrogen content. In certain embodiments, the composition has a sulfur content less than about 45 ppm (e.g., less than about 40 ppm, less than about 25 ppm, etc.). In certain embodiments, the composition has a nitrogen content less than about 0.2% by weight based on the total weight of the composition. Thus, in one embodiment, the invention provides an esterified cellulose pulp composition having a degree of substitution from about 0.1 to about 3.0, a sulfur content less than about 45 ppm, and a nitrogen content less than about 0.2% by weight based on the total weight of the composition.

The esterified cellulose pulp compositions of the invention can take a variety of forms. Representative forms include particles, pellets, fibers, and flakes.

Methods for Making Esterified Cellulose Pulp Compositions

In another aspect of the invention, methods for making an esterified cellulose pulp composition are provided. The methods are homogeneous methods in which the cellulose pulp starting material is dissolved in an ionic liquid (IL) to provide a cellulose solution.

In an example method of the invention, high alpha pulps (i.e., pulps having a cellulose content of at least 90% or higher, such as 95% based on Tappi T203) are not required for producing the cellulose esters. Among the advantages of the method of the invention are avoidance of costs associated with the preparation of a high alpha pulp starting material, which include additional treatment stages, such as a hydrolysis stage, required for some processes for preparing a high alpha pulp. Suitable pulps useful in the method include low DP kraft pulps, which increase throughput, productivity, and lowers cost of the method. Furthermore, because the esterification is homogenous, product quality control is potentially simplified.

Suitable cellulose pulps useful for making the esterified cellulose pulp composition have a hemicellulose content from about 5 to about 20% by weight based on the total weight of the pulp (as measured by HPLC sugar analysis, see U.S. Pat. No. 7,828,936, expressly incorporated herein by reference in its entirety); an alpha cellulose content of less than about 90% (e.g., 70-90%) by weight based on the total weight of the pulp (as measured by Tappi T203); and a degree of polymerization (DP) of from about 150 to about 1,000 (e.g., 400 to 800, 300 to 500, or 500 to 900) (as measured by ASTM D 1795). Representative cellulose pulps useful for making the esterified cellulose pulp composition include southern pine kraft pulp commercially available from Weyerhaeuser Company, Federal Way, Wash., under the designations Pearl® and Peach®.

Due to low lignin in the pulp starting material and washing, extraction, and/or bleaching steps post-esterification, the esterified cellulose pulp compositions of the invention so processed, which have a relatively high hemicellulose content, can have low color due to low nitrogen content.

Ionic Liquid Solvent System.

In some methods of the invention, an ionic liquid (IL) solvent system is used to dissolve the cellulose pulp and thereby facilitate cellulose esterification.

As used herein, the term "ionic liquid" refers to an ionic compound that is a liquid at temperatures below 150° C. Some ionic liquids useful in the practice of the present invention have melting points below room temperatures, some even below 0° C. The ionic compounds are liquid over a wide temperature range from the melting point to the decomposition temperature of the ionic liquid. Some example compounds that are considered to be ionic liquids include quaternary ammonium hydroxides such as aqueous solutions of tetrabutyl ammonium hydroxide, trimethylbenzylammonium hydroxide, tetraethyl ammonium hydroxide, and so forth.

Representative useful ionic liquids include 1-allyl, 3-methylimidazolium chloride ("AMIMCl"), 1-butyl, 3-methylimidazole chloride ("BMIMCl"), 1-ethyl-3-methylimidazole chloride ("EMIMCl"), 1-ethyl-3-methylimidazole acetate ("EMIMAc"), 1-ethyl-3-methylimidazolium dicyanamide, N-methyl-N-methylimidazolium dimethyl phosphate, 1-butyl-3-methylimidazolium dimethylphosphate, tetramethylguanidine formate, tetramethylguanidine acetate, tetramethylguanidine propionate, salts of 1,5-diazabicyclo[4.3.0]non-5-ene ("DBN") (with anions such as carboxylates, for example, 1,5-diaza-bicyclo[4.3.0]non-5-enium propionate), salts of 1,8-diaza-bicyclo[5.4.0]undec-7-ene ("DBU") (with carboxylate anions such as 1,8-diazabicyclo[5.4.0]undec-7-eniumpropionate), butymethylimidazolium-cyclohexyl carboxylate. BMIMCl, EMIMCl and EMIMAc are commercially available from Sigma Aldrich, BASF, and Merck Solvent Innovation GmbH. Other suitable ionic liquids include those described in U.S. Pat. Nos. 6,824,599, 7,749,318, 7,754,002, 7,828,936, 7,919,631, 8,044,120, and 8,067,488, each expressly incorporated herein by reference in its entirety.

In certain embodiments, the ionic liquid is 1-allyl-3-methylimidazolium chloride, 1-ethyl-3-methylimidazole acetate, 1,5-diaza-bicyclo[4.3.0]non-5-enium propionate, or 1,8-diaza-bicyclo[5.4.0]undec-7-enium propionate.

In certain embodiments, one or more of a catalyst, co-solvent, dilution agent, and drying agent may be used in combination with the ionic liquid. The catalyst, co-solvent, dilution agent, or drying agent can be added with, before, or after the ionic liquid.

Catalysts.

In certain embodiments, the method includes use of an esterification catalyst, such as by adding such a catalyst, for example to the cellulose solution to enhance the esterification reaction rate. Suitable catalysts include those known in the art to catalyze esterification. Example, representative catalysts include dimethylaminopyridine ("DMAP"), iodine, tosyl chloride, carbonyldiimidazole ("CDI"), dicyclohexylcarbodiimide ("DCC"), trifluoroacetic anhydride ("TFAA"), titanium (IV) compounds (e.g., organic titanates such as DuPont TYZOR), solid sulfonic acid resin, ytterbium(III) triflates ("YE"), vanadyl acetate ("VAc"), gadolinium triflates, scandium (III) triflates, and triethylamine. Mixtures of catalysts may also be used.

In one embodiment, the esterification catalyst is dimethylaminopyridine.

Co-Solvents.

In some methods, one or more co-solvents are used in order to swell cellulose and promote dissolution. Some co-solvents can dissolve cellulose ester more effectively than ionic liquids, and thus their use may promote esterification and lower solution viscosity for downstream processing such as washing. Typical co-solvents include protic and dipolar aprotic solvents and include those described in U.S. Pat. No. 7,828,936, expressly incorporated herein by reference in its entirety. Dipolar aprotic intercrystalline swelling agents include but are not limited to dimethyl sulfoxide ("DMSO"), dimethyl acetamide ("DMAc"), N-methylmorpholine oxide, formamide, dimethylformamide ("DMF"), pyridine, acetone, dioxane, N-methylpyrrolidine ("NMP"), piperylene sulfone, and hexamethylphosphoramide ("HMPA"). These dipolar aprotic intercrystalline swelling agents, by themselves, do not dissolve cellulose. In general, it is thought that liquids which produce a significant amount of swelling are those that are capable of forming hydrogen bonded complexes with the cellulose molecule. Dipolar aprotic intercrystalline swelling agents do not include imidazole based agents or amine based agents. Protic solvents include, but are not limited to water, low molecular alcohols such as methyl, ethyl, propyl, butyl, and amyl alcohol, ethylene glycol, acetic acid, methylamine, di- and triethylamine, and butylamine, and mixtures thereof.

In certain embodiments, the co-solvent is DMSO, DMAc, DMF, NMP, or acetic acid.

Dilution Agents.

In some methods, one or more dilution agents is/are used in order to lower viscosity and promote uniform dissolution and/or uniform reaction. Typical dilution agents include water, acid, alkaline, organic solvents, or mixtures thereof.

Drying Agents.

In some methods, a drying agent is used in order to remove residue water from the ionic liquid (IL). Typical drying agents include magnesium sulfate and molecular sieves, among others.

Representative Methods

The cellulose dissolution process is carried out at a temperature of 20 to 180° C. and is controlled at a temperature within this range. The dissolution mixture is stirred or kneaded to thoroughly mix the pulp with the dissolution chemicals. The dissolution can take place under an inert gas, under atmospheric condition, under a vacuum (e.g., 0.5 to 3 mm Hg). The dissolution time is typically from 0.2 to 20 hours.

In certain embodiments, esterification agents are added after dissolution of the pulp. Representative esterification agents are described above and include acetic anhydride, propionic anhydride, or other anhydride with 4 to 12 carbon. In a continuous process, one reactor may be used for dissolution and a different reactor may be used for esterification and the esterification agents can be added there. A batch process can also be used. In a continuous process, the esterification agents are added when cellulose is dissolved. The esterification is carried out at a temperature of 20 to 180° C. and at a pressure of 0.2 to 10 atm. The process time can be from 0.2 to 20 hours.

After esterification, the product ester composition may be precipitated with a non-solvent such as water. Other non-solvents useful for precipitation include alcohols such as methanol, ethanol, and their mixtures with water. If the final product is a high viscosity mass, grinding (e.g., by pulsing in a non-solvent with a Waring blender) is used to break the mass into powder for more effective washing and purification. The product ester composition can be separated by filtration and further washed and/or extracted using water, alcohols, or a mixture of these to remove ionic liquid, byproduct (acids), unreacted anhydride, catalyst, and other additives such as co-solvents, dilution agents. Grinding the final product during washing, washing with a non-solvent such as water at higher temperatures, use of organic solvents such as methanol and ethanol, and various combinations of such measures, are also effective to remove more impurities, including solvent residue. The ionic liquid is separated and purified from the filtrate with color removal (e.g., charcoal), membrane filtration, and distillation and returned to the process. The rest of the filtrate, the byproducts, washing liquid, and non-solvents are recovered through separation, distillation or disposed.

As noted above, the composition can include a mixture of cellulose esters, mixed cellulose esters, hemicellulose esters, and mixed hemicellulose esters. The product can be further washed, optionally bleached, extracted, dried, and ground for further use.

In one embodiment, the method includes:

(a) combining an ionic liquid and a cellulose pulp to provide a cellulose solution, wherein the cellulose pulp has an alpha cellulose content from 70 to 90 wt %, a hemicellulose content from about 5 to about 20% by weight, and a degree of polymerization from about 150 to about 1,000;

(b) adding an esterification agent to the cellulose solution to provide a reaction mixture; and (c) isolating an esterified cellulose pulp composition from the reaction mixture.

In certain embodiments, the method further includes heating the reaction mixture to a temperature of from 20° C. to about 180° C. (such as after step (b) and before step (c)), adding a catalyst (such as during step (b)), and so forth. In a method that includes heating, the reaction mixture may be heated for a duration of from 0.2 hour to 20 hours. In certain embodiments, the ionic liquid is heated to a temperature of from 20° C. to 180° C. prior to combining with the cellulose pulp.

In certain embodiments, the esterification agent is an anhydride. Representative anhydrides have the formula: $R^1—C(=O)OC(=O)—R^2$, wherein $R^1$ and $R^2$ are independently selected from $C_{1-12}$ alkyl. Preferred anhydrides include anhydrides in which $R^1$ and $R^2$ are $C_{1-6}$ alkyl (e.g., methyl, ethyl, propyl, butyl, pentyl, hexyl). In one embodiment, the esterification agent is acetic anhydride. In another embodiment, the esterification agent is propionic anhydride.

In another embodiment, the invention provides a method of making an esterified cellulose pulp composition, including:

(a) combining an ionic liquid and a cellulose pulp to provide a cellulose solution;

(b) adding an esterification agent, and optionally a catalyst, to the cellulose solution to provide a reaction mixture; and (c) isolating an esterified cellulose pulp composition from the reaction mixture.

In such a method, the esterified cellulose pulp composition has a degree of substitution from about 0.1 to about 3.0 and either a hemicellulose content from about 2.5 to about 20 percent by weight based on the total weight of the composition, a sulfur content less than about 45 ppm, and/or a nitrogen content less than about 0.2% by weight based on the total weight of the composition.

Articles of Manufacture

The esterified cellulose pulp composition can be mixed, blended with other polymers, or used alone in a variety of applications (e.g., packaging, fiber, molding, articles, non-woven) via a variety of processing techniques (e.g., injection molding, film casting, and fiber spinning).

In a further aspect, the invention provides an article comprising an esterified cellulose pulp composition of the invention. The article can have a variety of forms. In certain embodiments, the article is in a form of a fiber, a filament, a film, a membrane, a molded piece, an extruded piece, or a spun piece. The article can be a packaging material, a textile, an injection molding, a spun fiber, a coating composition, or an absorbent product. As noted above, the article can be a blend or composite of the esterified cellulose pulp composition with other polymers (natural, synthetic polymers, starch, nanocellulose or its derivatives, or microfibrillated cellulose, powdered cellulose, hemicellulose) or other additives (sugar oligomers, nanoclay, $TiO_2$, carbon modified $TiO_2$) for enhanced mechanical properties (e.g., strength, elongation, impact, toughness, biodegradability, photodegradability, permeability, etc.).

The following representative examples are provided for the purpose of illustrating, not limiting, the invention.

Example 1: Cellulose Acetate Control Preparation

In this example, a process for producing a cellulose acetate control is described.

Fluffed commercial dissolving pulp (4.3 gram) (hemicellulose content of 2.51%, xylan content of 1.34%, Tappi alpha of 95.5%, R10 and R18 of 95.0% and 96.6%, respectively, and DP of 1400 produced Weyerhaeuser Company, Federal Way, Wash.) was placed in a bottle (125 ml). To the pulp was added 10.5 ml glacial acetic acid (HAc) at 25° C. The bottle was capped and shaken for 15 minutes.

A catalysis solution (CS) was prepared by combining 95% sulfuric acid ($H_2SO_4$) (9 grams) and 100 ml glacial acetic acid (HAc). A pretreatment solution (PS) was prepared by combining 20 ml CS and 300 ml HAc.

To the bottle containing the pulp in HAc was added 24.5 ml PS. The bottle was capped, shaken for 3 minutes, and tumbled for 8 minutes. Then, 2 ml CS followed by 16 ml acetic anhydride was added to the bottle. The bottle was capped, shaken for 3 minutes, and tumbled for 70 minutes.

A final solution (FS) was prepared by adding 30 moles water to 195 ml HAc. To the bottle containing pulp treated with CS and PS was added 15 ml FS. The bottle was capped and shaken for 1 minute to provide the reaction solution, which was allowed to stand until a clear solution was obtained. Then, cellulose acetate was precipitated from the reaction solution by the addition of a 10 to 30% magnesium acetate solution.

The precipitated cellulose acetate was collected by filtration, washed several times until the wash liquid had a neutral pH, and dried.

The result of DS analysis for this cellulose acetate control (Sample 1) is provided in Table 1. Referring to Table 1, with an acetic anhydride (AA)/cellulose addition ratio of 6.4, the DS of the product is 2.2. High DP dissolving pulps (1400 or greater) are hydrolyzed in this process as evidenced by the product cellulose acetate having a DP of about 100 to 400.

Example 2: Procedure for Synthesis of a Representative Ionic Liquid

In this example, a laboratory procedure is described for the synthesis of a representative ionic liquid: 1-allyl-3-methylimidazolium chloride (AMIMCl). In the procedure, N-methylimidazone (greater than 99% purity) and allyl chloride (analytical purity) were used to synthesize the ionic liquid.

N-Methylimidazone (22.908 g, 0.275 mol) and allyl chloride (25.245 g, 0.33 mol) were added to a 100 ml 3-neck flask under nitrogen. The resulting mixture was heated at 60° C. in an oil bath with magnetic stirring. The initially colorless liquid gradually changed to a yellow color and became viscose. After 7 hours, the reaction was complete. Excess allyl chloride was removed by rotary evaporation to provide the crude product. The crude product was stirred with ethyl ether to extract residue N-methylimidazone. The extracted product was dried at 80° C. under vacuum for 48 hours to provide a yellowish, viscous liquid.

Example 3: Representative Procedure for Dissolving Cellulose in an Ionic Liquid with Hemicellulose Retention In this example, the dissolution of cellulose in a representative ionic liquid with retention of hemicellulose in the pulp product is described.

Weyerhaeuser Peach® pulp (5.4 gram) having a DP of 760, alpha cellulose of 86% and a hemicellulose content of 12% (xylan 6.5%, mannan 5.5%) was mixed with 103 gram of AMIMCl, prepared as described in Example 2, in a flask and stirred for about 1 hour at 105° C. to provide a 5% cellulose solution. An aliquot of the cellulose solution was used to cast cellulose films for analysis. The films had 8.9% hemicellulose (xylan 4.3%, mannan 4.6%).

The dissolution experiment was continued and aliquots of the cellulose solution were taken at 5 and 9 hours, respectively, and cellulose films were cast. These films had hemicellulos contents of 4.37% (xylan 1.50%, mannan 2.87%) and 2.75% (xylan 1.33%, mannan 1.42%), respectively.

Example 4: Representative Procedure for Cellulose Dissolution and Cellulose Ester Preparation Using Low DP Pulp In this example, cellulose dissolution and the preparation of a representative esterified cellulose pulp composition of the invention from a low DP pulp are described.

Weyerhaeuser Peach® pulp (6.8 gram) having a DP of 440, a hemicellulose content of 11.3% (xylan 6.1%, mannan 5.2%), and alpha of 81.5%, was mixed with 62 grams of AMIMCl, prepared as described in Example 2, in a flask and stirred for about 2 hours at 105° C. to provide a cellulose solution. To this cellulose solution was added acetic anhydride (20.0 gram) and the reaction mixture was stirred for 5 hours at 105° C. to provide the crude product. The crude product was collected by filtration and washed with deionized ("DI") water until the pH of the filtrate was 5.6. The resulting solid cellulose acetate was dried for IR and DS analysis. DS was 2.33 and FTIR showed an ester peak at 1746 $cm^{-1}$ (see Sample 22, Table 1). Compared with control (Sample 1, Table 1), the ionic liquid system utilized less acetic anhydride to provide greater DS cellulose acetate. Conversion yields for acetic anhydride can be as high as 99% in ionic liquid systems (see, for example, Sample 25d, Table 1).

Example 5: Representative Procedure for Cellulose Dissolution and Cellulose Ester Preparation Using Additives In this example, cellulose dissolution and the preparation of representative esterified cellulose pulp compositions of the invention using additives are described.

Weyerhaeuser Peach® pulp (7.2 gram) having a DP of 760 was mixed with 54.0 grams of AMIMCl, prepared as described in Example 2, with and without additives, in a flask and stirred for about 1 hour at 105° C. to provide a cellulose solution. The additives were 60% benzylmethylammonium hydroxide (BMAH) (1.2 grams) (Table 1, Sample 3) and dimethyl sulfoxide (DMSO) (1.1 grams) (Table 1, Sample 5). The solution with BMAH is less dark than the solution with DMSO or with no additive (Table 1, Sample 4). To these solutions was added acetic anhydride (22.4 grams) and the reaction mixtures were stirred for another hour at 105° C. to provide the cellulose esters. The final mixture with BMAH was a lighter-colored viscous solution compared to the mixture with no additive (Sample 3 vs 4, Sample 6 vs 6a), while the mixture with DMSO was the darkest. The cellulose acetate products were washed with water and dried to provide cellulose acetate for IR analysis.

The cellulose ester prepared with BMAH was flake-like with lighter color than those with DMSO or with no additive, which were powder-like. All of the product cellulose esters showed an ester band at 1741.9 $cm^{-1}$. However, the cellulose ester from solutions with DMSO had increased band intensity at 3452 $cm^{-1}$ (—OH) due to the low degree of substitution (DS). The reactions were repeated for solution with BMAH and with no additive and the results are summarized in Table 1, Samples 3, 4, and 5. Low DS cellulose acetate was also produced with low BMAH addition (Table 1, Sample 6).

Example 6: Representative Procedure for Cellulose Dissolution and Cellulose Ester Preparation In this example, cellulose dissolution and the preparation of a representative esterified cellulose pulp composition of the invention are described.

The procedure for Example 5 (BMAH additive) was repeated with increased BMAH such that the water content was 6.7 wt. % in the ionic liquid solution (10 weight % BMAH) (Sample 7), the Weyerhaeuser Peach® pulp was swollen in ionic liquid after 5 hours. The cellulose esters from the mixture were fiber-like with lighter color. Cellulose acetate from the solution with no additive (in which cellulose was dissolved in one hour) had a darker color (Table 1, Samples 4 and 6a).

Example 7: Representative Procedure for Cellulose Dissolution and Cellulose Mixed Ester Preparation In this example, cellulose dissolution and the preparation of representative mixed esterified cellulose pulp compositions of the invention are described.

Weyerhaeuser Peach® pulp (6.9 gram) having a DP of 760 was mixed with 64 grams of AMIMCl, prepared as described in Example 2, in a flask and stirred for about 1 hour at 105° C. to provide a cellulose solution. Acetic anhydride (15 grams) and propionic anhydride (6 grams) were added to the cellulose solution at 105° C. to provide the cellulose mixed ester. Samples were taken at 30 and 70 minutes reaction times. The sample mixtures were washed with water to provide cellulose acetate propionate for IR analysis. Each mix ester sample showed ester bands at 1742.9 $cm^{-1}$. Less intense bands between 800 and 900 $cm^{-1}$ were observed for the mixed esters for the propyl group. Commercial cellulose acetate with DS of about 2.45 from Aldrich showed only a single band between 800 to 900 $cm^{-1}$ (Table 1, Samples 8 and 9). These mixed esters had good solubility in acetone.

Example 8: Cellulose Dissolution Time and Temperature Effect on Cellulose Ester Preparation In this example, the effect of cellulose dissolution time and temperature on the preparation of a representative esterified cellulose pulp composition of the invention are described.

Weyerhaeuser Peach® pulp (1 gram) with a DP of 760 was mixed with 32 grams of AMIMCl, prepared as described in Example 2, in a flask and stirred for about 1 hour at 105° C. to provide a cellulose solution. Acetic anhydride (0.46 gram) was added to the cellulose solution and stirred for another hour at 105° C. to provide a low DS cellulose ester. The mixture was washed with water to provide cellulose acetate for IR analysis (CA1). The experiment was repeated with a reaction time of 4 hours (CA3). This experiment was repeated except 0.23 gram of acetic anhydride was used and the reaction time was 4 hours (CA2).

Figure 2:
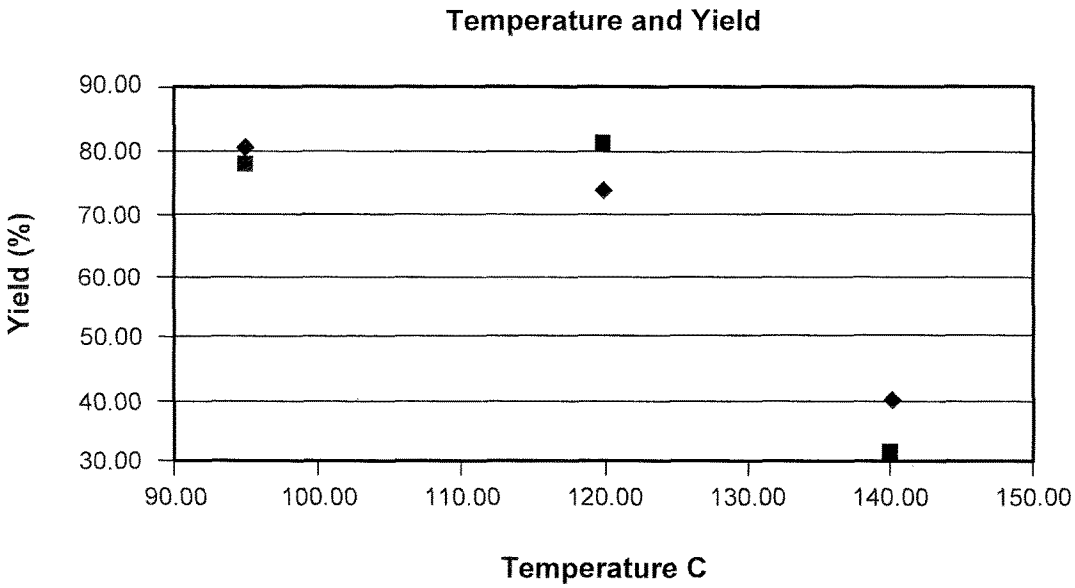
FIG. 2 is a graph illustrating anhydride conversion yield as a function of temperature for a representative esterified cellulose pulp, cellulose acetate, with a dissolution time of 3 hours, acetic anhydride addition time of 0.25 hour, and acetylation time of 15 hours.

CA3 showed higher intensity ester band in FTIR spectra due to longer reaction time (4 hours) and higher acetic anhydride to cellulose ratio, while CA1 and CA2 had low intensity ester band for lower DS ester at about 1748 $cm^{-1}$. FIG. 1 shows that acetylation time affects product yield and FIG. 2 shows that acetylation temperature affects product yield (the squares and diamonds indicate the same samples with two different DS, or yield using two different DS methods).

Example 9: Solvent Extraction and Bleaching Effect on Cellulose Ester Preparation In this example, the effect of solvent extraction and bleaching effect on the preparation of a representative esterified cellulose pulp composition of the invention is described.

Dried Weyerhaeuser Peach® pulp (9.3 grams) having a DP of 440 was added in a flask at 105° C. in an oil bath, and then 82.6 grams of EMIMCl (dried with $MgSO_4$ as drying agent) was decanted into the flask and stirred for 5 hours to provide a cellulose solution. Acetic anhydride (19.80 grams) was added dropwise (one drop every 15 seconds) to the cellulose solution and stirred for another 6 hours at 105° C. to provide the cellulose ester. The mixture was washed twice with DI water, then once with DI water adjusted to a pH of 8.2 with magnesium acetate. The cellulose ester was filtered after each wash. The filtrate from the second and third washes had a pH of 3.1 and 6.2, respectively. The cellulose ester solids were extracted with ethanol to remove color. Half of the product was dried at 60° C. for IR, DS, and nitrogen analysis. The other half was bleached with household bleaching at pH of 10.18, then washed and dried before IR analysis and other analysis (see Table 1, Samples 26 and 27).

Cellulose acetate washed without bleaching had a DS of 2.76, while the cellulose acetate washed with bleaching has a DS of 2.65. The former has 380 ppm of nitrogen while the latter has 270 ppm of nitrogen. The same test was repeated except the product was not extracted with ethanol. The product without bleaching had 8400 ppm nitrogen while those with bleaching have 1200 ppm nitrogen. Bleaching also lowered DS. Ethanol extraction removed more nitrogen containing solvent residue. Bleaching also lowered DS slightly (Sample 27 vs 26). However, bleaching at lower pH lowered DS more (Samples 20 vs 21, Sample 25 vs 24). Bleaching at neutral or higher pH will have less damage to the final product. Bleaching increases brightness, and removes more nitrogen containing solvent residue in the final product.

Example 10: Representative Procedure for Cellulose Dissolution and Cellulose Mixed Ester Preparation Using Low DP Pulp In this example, cellulose dissolution and the preparation of a representative mixed esterified cellulose pulp composition of the invention from low DP pulp are described.

Dried Weyerhaeuser Peach® pulp (4.8 grams) having a DP of 440 was added to a flask at 105° C., then 80.0 grams of EMIMCl (dried with 1.0 gram of magnesium sulfate drying agent) was decanted into the flask and the material was stirred for 1 hour to provide cellulose solution. Acetic anhydride (6 grams) and propionic anhydride (9 grams) were added dropwise (one drop every 15 seconds) to the cellulose solution at 95° C. which was stirred for another 11 hours to provide the cellulose mixed ester. The mixture was washed twice with DI water, then once with DI water with a household bleaching agent, then with DI water. The solids were extracted with ethanol to remove color. The product was dried at 66° C. for IR, DS and nitrogen analysis (Tappi 418). The DS for acetyl group is 0.43, and the DS for propyl group is 0.52 (Table 1, Sample 23).

Example 11: Representative Procedure for Cellulose Ester Preparation Using Low DP Pulp for Optimal Conversion In this example, the preparation of representative esterified cellulose pulp compositions of the invention using low DP pulp for optimal conversion are described.

Dried Weyerhaeuser Peach® pulp (4.8 grams) having a DP of 440 was added into a flask at 105° C., then 84.3 grams of EMIMCl (dried with 1.0 gram of magnesium sulfate drying agent) was decanted into the flask and the material was stirred for 1 hour to provide a cellulose solution. Acetic anhydride (6.8 to 9.9 grams) was added dropwise (one drop every 15 seconds) to the cellulose solution at 95° C. and stirred for another 11 hours to provide the cellulose mixed ester. The mixture was washed twice with DI water. The solids were extracted with ethanol to remove color. The product was dried at 66° C. for IR, DS and nitrogen analysis. Samples with less acetic anhydride/AGU ratio had higher conversion of acetic anhydride to cellulose acetate (e.g., 99% conversion yield for Sample 25d, 87% conversion for Sample 25c, 82% conversion for Sample 25b, 57 to 68% conversion for Samples 25 and 24 (see Table 1)).

Example 12: Representative Procedure for Cellulose Ester Preparation Using Low DP Pulp at High Concentration In this example, the preparation of representative esterified cellulose pulp compositions of the invention using low DP pulp at high concentration are described.

Dried Weyerhaeuser Peach® pulp (14.53 grams) having a DP of 440 was added into a flask at 105° C., then 90.3 grams of EMIMCl (dried with 1.0 gram of magnesium sulfate drying agent) was decanted into the flask and the material was stirred for 1 hour to provide the cellulose solution. Acetic anhydride (30.6 grams) was added dropwise (one drop every 15 seconds) to the cellulose solution at 95° C. and stirred for another 11 hours to provide the cellulose mixed ester. The mixture was washed twice with DI water; the solids were extracted with ethanol to remove color. The product was dried at 66° C. for IR, DS and nitrogen analysis. The DS for acetyl group was 2.6 (Table 1, Samples 29 and 30).

TABLE 1

Cellulose ester and mixed ester preparation.

| Sample | Solvent (g) | Pulp (g) | AA (g) | PA (g) | Cp (%) | (AA + PA)/AGU (mol ratio) | Additive | Temp (° C.) |
|---|---|---|---|---|---|---|---|---|
| | | | | | None | | | |
| 1 | 0 (control) | 4.3 | 17.2 | 0 | <3 | 6.35 | — | 25 |
| | | | | | AMIMCI | | | |
| 3 | 54 | 7.2 | 22.4 | 0 | 11.76 | 4.94 | 1.2 g BMAH | 105 |
| 4 | 54 | 7.2 | 22.4 | 0 | 11.76 | 4.94 | — | 105 |
| 5 | 54 | 7.2 | 22.4 | 0 | 11.76 | 4.94 | 1.1 g DMSO | 105 |
| 6 | 7.5 | 0.32 | 1.0 | 0 | 4.09 | 4.96 | 0.26 g BMAH | 105 |
| 6a | 8.2 | 0.37 | 1.0 | 0 | 4.32 | 4.29 | — | 105 |
| 7 | 51 | 7.0 | 14.2 | 0 | 12.07 | 3.22 | 10 g BMAH | 105 |
| 8 | 64 | 6.9 | 15 | 6.0 | 9.73 | 4.54 | — | 105 |
| 9 | 64 | 6.9 | 15 | 6.0 | 9.73 | 4.54 | — | 105 |
| 22 | 62 | 6.8 | 20 | 0 | 9.88 | 4.67 | — | 106 |
| | | | | | EMIMCI | | | |
| 20 | 77 | 4.8 | 13.8 | 0 | 5.87 | 4.57 | MgSO4 | 95 |
| 21 | 77 | 4.8 | 13.8 | 0 | 5.87 | 4.57 | MgSO4 | 95 |
| 23 | 80 | 4.8 | 6.0 | 9.0 | 5.66 | 4.32 | MgSO4 | 95 |
| 24 | 84.3 | 4.8 | 9.9 | 0 | 5.39 | 3.28 | MgSO4 | 95 |
| 25 | 84.3 | 4.8 | 9.9 | 0 | 5.39 | 3.28 | MgSO4 | 95 |
| 25b | 84.3 | 4.8 | 8.19 | 0 | 5.39 | 2.71 | MgSO4 | 95 |
| 25c | 84.3 | 4.8 | 7.78 | 0 | 5.39 | 2.57 | MgSO4 | 95 |
| 25d | 84.3 | 4.8 | 6.8 | 0 | 5.39 | 2.25 | MgSO4 | 95 |
| 26 | 82.6 | 9.3 | 19.8 | 0 | 10.12 | 3.38 | MgSO4 | 95 |
| 27 | 82.6 | 9.3 | 19.8 | 0 | 10.12 | 3.38 | MgSO4 | 95 |
| 29 | 90.3 | 14.53 | 30.6 | 0 | 13.86 | 3.34 | MgSO4 | 95 |
| 30 | 78.17 | 13.43 | 28.37 | 0 | 14.66 | 3.36 | MgSO4 | 95 |

TABLE 1-continued

Cellulose ester and mixed ester preparation.

| Sample | Time (min) | Bleaching? | Filtrate pH | Drying (° C.) | DS | Yield | IR | N % | acetone soluble? |
|---|---|---|---|---|---|---|---|---|---|
| | | | | Control (no solvent) | | | | | |
| 1 | 70 | | | 25 | 2.2 | | CA | | good |
| | | | | | AMIMCI | | | | |
| 3 | 60 | | | 25 | | | CA | | light |
| 4 | 60 | | | 25 | 2.3 | | CA | | dark |
| 5 | 60 | | | 25 | | | CA | | darker |
| 6 | 60 | | | 25 | 1.3 | | CA | 0.100 | light |
| 6a | 60 | | | 25 | | | CA | | dark |
| 7 | 60 | | | 25 | | | CA | | fiber |
| 8 | 60 | | | 25 | 1.3 | | CAP | | best |
| 9 | 110 | | | 25 | | | CAP | 0.200 | best |
| 22 | 120 | no | NA | 25 | 2.3 | 0.50 | CA | 0.100 | |
| | | | | | EMIMCI | | | | |
| 20 | 660 | once | 3.6 | 60 | 1.7 | 0.37 | | | |
| 21 | 660 | twice | 7.7 | 60 | 2.3 | 0.49 | | | |
| 23 | 660 | yes | 6 | 60 | 1.1 | 0.25 | CAP | 0.094 | |
| 24 | 660 | no | 7 | 66 | 2.2 | 0.68 | | 0.084 | |
| 25 | 660 | yes | 8 | 66 | 1.9 | 0.57 | | 0.120 | |
| 25b | 660 | no | 7 | 66 | 2.2 | 0.82 | | | |
| 25c | 660 | no | 7 | 66 | 2.2 | 0.87 | | | |
| 25d | 660 | no | 7 | 66 | 2.2 | 0.99 | | | |
| 26 | 660 | no | 6.2 | 66 | 2.8 | 0.82 | | 0.038 | |
| 27 | 660 | yes | 8.4 | 66 | 2.7 | 0.78 | | 0.027 | |
| 29 | 660 | no | 6.2 | 66 | 2.6 | 0.78 | | 0.016 | |
| 30 | 660 | no | 6.2 | 66 | 2.8 | 0.82 | | 0.028 | |

AA = acetic anhydride;
PA = propionic anhydride;
Cp = pulp concentration in starting reaction mixture;
AGU = anhydroglucose unit;
temp = temperature.
DS = degree of substitution;
Yield = conversion of anhydride to cellulose ester (1 = 100% conversion);
IR = infrared spectra;
N % = nitrogen content %;
CA = cellulose acetate;
CAP = cellulose acetate propionate.

Intrinsic viscosity of the esters were determined to be from 0.7 to 3.0 dL/g using NMP as solvent.

Example 13: Representative Procedure for Cellulose Dissolution and Long Chain Cellulose Ester Preparation with Catalyst Cellulose esters or mixed esters from ionic liquids were prepared by using anhydrides having 6 or 8 carbons (labeled as C6 and C8), and acetic anhydride (AA). Catalysts included DMAP (dimethylamino pyridine), tosyl chloride, CDI (carbonyldiimidazole), DCC (dicyclohexylcarbodiimide), TFAA (trifluoroacetic anhydride), titanium (IV) compounds, solid sulfonic acid resin, ytterbium(III) triflates (YF), vanadyl acetate (VAc), gadolinium triflates, scandium (III) triflates, TEA/DMAP (1/1 molar ratio). The catalysts were used to shorten reaction time: comparing Samples 33, 35, 36, 37, 38, and 39 with Samples 32 and 31 (two controls), or comparing Sample 44 with Sample 41 (control). The results are summarized in Table 2.

TABLE 2

Cellulose ester preparation with catalysts (15% cellulose in IL, Peach pulp with DP of 440 and different ratio of AA/AGU or anhydroglucose unit).

| | Reaction condition | | | | Dissolution | | Esterification* | |
|---|---|---|---|---|---|---|---|---|
| Sample | Additive | DS | AA/AGU (mol ratio) | Conversion (AA %) | Temp (° C.) | Time (hr) | Addition (min) | Reaction (hr) |
| | | | | EMIMCI | | | | |
| 31 | — | 3.0 | 3.3 | 91 | 95 | 6 | 60 | 15 |
| 32 | — | 2.8 | 3.3 | 86 | 95 | 6 | 15 | 18 |
| 33 | 5% DMAP | 2.7 | 3.0 | 91 | 95 | 6 | 15 | 0.25 |
| 34 | 1% DMAP | 2.0 | 3.0 | 67 | 95 | 6 | 15 | 0.75 |
| 35 | 3% DMAP | 2.6 | 3.0 | 88 | 95 | 6 | 15 | 0.75 |
| 36 | H2SO4 | 2.7 | 3.0 | 90 | 95 | 6 | 15 | 1 |
| 37 | VAc | 2.8 | 3.0 | 92 | 95 | 6 | 15 | 1 |

TABLE 2-continued

Cellulose ester preparation with catalysts (15% cellulose in IL, Peach pulp with DP of 440 and different ratio of AA/AGU or anhydroglucose unit).

| | Reaction condition | | | | Dissolution | | Esterification* | |
|---|---|---|---|---|---|---|---|---|
| Sample | Additive | DS | AA/AGU (mol ratio) | Conversion (AA %) | Temp (° C.) | Time (hr) | Addition (min) | Reaction (hr) |
| 38 | YF | 2.5 | 3.0 | 85 | 95 | 6 | 15 | 1 |
| 39 | TEA/DMAP (1/1), 5% | 2.6 | 3.0 | 85 | 95 | 6 | 15 | 0.25 |
| | | | | EMIMAc | | | | |
| 40 | — | 2.2 | 2.9 | 76 | 95 | 6 | 15 | 0.25 |
| 41 | — | 1.8 | 3.0 | 60 | 60 | 2 | 35 | 0.75 |
| 42 | — | 2.8 | 3.0 | 94 | 75 | 2 | 60 | 0.75 |
| 43 | — | 2.7 | 3.0 | 91 | 95 | 2 | 15 | 16 |
| 44 | Acetic acid | 2.5 | 2.9 | 87 | 95 | 2 | 15* | 0.5 |
| | | | EMIMCI (5% DMAP on pulp for test below) | | | | | |
| 45 | C6/AGU (1.1) | 0.9 | 2.1 | 42 | 95 | 6 | 15 | 0.58 |
| 46 | C6/AGU (0.6) | 1.7 | 2.6 | 66 | 95 | 6 | 15 | 0.58 |
| 47 | 05/AUG (1.1) | 1.49 | 2.1 | 71 | 95 | 6 | 15 | 0.75 |
| 48 | C6/AGU (1.1) | 1.41 | 2.1 | 67.3 | 95 | 6 | 15 | 0.75 @ 85° C. |
| 49 | C6/AGU (1.1) | 1.15 | 2.1 | 54.8 | 95 | 6 | 15 | 0.75 @ 85° C. |
| 50 | C7/AGU (1.1) | 1.46 | 2.1 | 69.5 | 95 | 6 | 15 | 0.75 @ 85° C. |
| 51 | C8/AGU (1.1) | 1.22 | 2.1 | 58.1 | 95 | 6 | 15 | 0.75 @ 85° C. |
| 52 | C6/AGU (1.1) | 1.28 | 2.1 | 61.0 | 95 | 6 | 15 | 0.75 @ 85° C. |
| 53 | C6/AUG (2.1) | .82 | 1.1 | 74.5 | 95 | 5 | 10 | 0.58 |

*Esterification temperature: 95° C. except as noted.

Additional notes on Table 2:

Sample 48: HAc added at 100 wt. % on pulp with esterification agents to increase the solubility of the end product.

Sample 50: HAc added at 100 wt. % on pulp with esterification agents to increase the solubility of the end product and temperature decreased to 85° C. for addition and reaction after addition.

Sample 51: HAc added at 100 wt. % on pulp with esterification agents to increase the solubility of the end product and temperature decreased to 85° C. for addition and reaction after addition.

Sample 52: BMIMCl used with Peach® pulp at 10 wt. % concentration.

Sample 53: High purity EMIMCl from Solvent Innovation used in reaction.

Example 14: Representative Procedure for Cellulose Dissolution and Cellulose Ester Preparation In this example, cellulose dissolution and cellulose ester preparation were carried out with a premixer from C. W. Brabender (South Hackensack, N.J.). The mixer is connected with Intelli-Torgue Plasti-Corder for data acquisition.

The premixer was programmed to heat to 90° C.; when 90° C. was reached, 176 ml of EMIMAc was added; once the temperature was 90° C. again, Weyerhaeuser Peach® pulp (44 grams) having a DP of 760 was added. The mixture was programmed to be mixed at 80 RPM. After a few minutes, the temperature was 90° C. again and torque reading was constant at about 6.7 KNm. At two hours, the total energy reading was 342 KNm, the temperature was 92° C. and the torque was 7.5 KNm.

The dissolution continued for another 2 hours, then the mixing was stopped to remove some cellulose sample. Then the mixing continued at 40 RPM and 36 gram of acetic anhydride was added slowly from the feeding port on the premixer to the mixture in the kneader (10 minute to add all the acetic anhydride). The temperature was 92° C. The reaction continued for another 40 minutes, then was stopped and the cellulose acetate was removed for coagulation/precipitation, grinding with Waring blender, washing with water, extraction with ethanol and drying for analysis.

Films were formed from the cellulose solutions prepared as described above. The cellulose film had 9.43 weight % hemicellulose (4.80 weight % xylan and 4.63 weight % mannan). The cellulose acetate had 3.86 weight % hemicellulose (2.32 weight % xylan and 1.54 weight % mannan).

Example 15: Cellulose Ester and Hemicellulose Ester Composition

Cellulose solution from ionic liquid (EMIMAc) or cellulose ester from solutions in different solvents was cast to produce films for sugar analysis (Table 3).

TABLE 3

Hemicellulose in films cast from cellulose from different pulps, cellulose acetate (CA) from Aldrich, and cellulose mixed ester (CAH, cellulose acetate hexanoate).

| Film sample | Pulp | Solvent | Xylan | Mannan |
|---|---|---|---|---|
| Cellulose | Peach | EMMICl | 5.54 | 4.71 |
| Cellulose | V60 (from Buckeye) | EMMICl | 0.69 | 0.80 |
| CA | Aldrich | MeCl2/methanol | 0.06 | 0.27 |
| CA (example 12) | Peach | MeCl2/methanol | 2.32 | 1.54 |
| CAH (59, table 4) | Peach | MeCl2/methanol | 3.07 | 4.50 |
| CAH (56, table 4) | Peach | Acetone | 2.90 | 2.41 |
| CAH (54, table 4) | Peach | Acetone | 3.50 | 2.94 |
| CAH (61, table 4) | Peach | MeCl2/methanol | 1.95 | 1.29 |
| CAH (58, table 4) | Peach | MeCl2/methanol | 3.48 | 3.01 |
| CAH (55, table 4) | Peach | Acetone | 2.90 | 2.42 |
| CAH (49, table 2) | Peach | Acetone | 3.58 | 3.10 |

Cellulose films were prepared from 8% solutions dissolved in EMIMCl at 85° C. for 1.5 hours with stirring. V60 is a dissolving wood pulp from Buckeye Company with alpha at about 93.8%, 1.72% xylan, 1.36% mannan and DP of about 690. V60 has lower hemicellulose than Peach® pulp and the film from the V60 pulp has even lower hemicellulose content (<1.5%) than the films from Peach® (>10%).

Compared with control cellulose acetate from Aldrich, cellulose esters or mixed esters from Peach® pulp having a DP of 520 had much higher xylan and mannan content.

TABLE 4

Preparation conditions for the samples CAH (AA and hexanoic anhydride (C6), 15% cellulose in the ionic liquid, Peach ® pulp with DP of 440 and varying ratios of AA/AGU (anhydroglucose unit)).

| | Condition Dissolution | | | | Dissolution | | Esterification | |
|---|---|---|---|---|---|---|---|---|
| Sample | Additive | DS | AA/AGU (mol ratio) | Conversion (%) | Temp (° C.) | Time (hr) | Addition (min) | Reaction (hr) |
| EMIMCI (5% DMAP on pulp for test below) | | | | | | | | |
| 54 | C6/AGU (1.1) | 1.3 | 2.1 | 61.9 | 95 | 6 | 15 | 0.75 @ 85° C. |
| 55 | C6/AGU (1.1) | 0.75 | 2.1 | 35.7 | 95 | 6 | 15 | 0.75 @ 85° C. |
| 56 | C6/AGU (1.1) | 1.7 | 2.1 | 81.0 | 95 | 4 | 15 | 0.75 @ 85° C. |
| BMIMCI (5 wt. % DMAP for all below) | | | | | | | | |
| 58 | C6/AGU (1.1) | 0.97 | 2.1 | 46.2 | 95 | 6 | 15 | 0.75 @ 85° C. |
| 59 | C6/AGU (1.1) | 1.3 | 2.1 | 61.9 | 95 | 6 | 15 | 0.75 @ 85° C. |
| EMIMCI/NMP (70/30 w/w) (5 wt. % DMAP) | | | | | | | | |
| 61 | C6/AGU (1.1) | .49 | 2.1 | 23.3 | 95 | 4 | 15 | 2.75 @ 75° C. |

Additional notes on Table 4:

Sample 54: acetic acid added with anhydride at 100 wt. % of pulp to decrease viscosity and increase end solubility.

Sample 55: DP of Weyerhaeuser Peach® pulp was 520.

Sample 56: Alpha-cyclodextrin acetylated in ionic liquid before addition of cellulose—½ hour dissolution for alpha-cyclodextrin, 10 second addition, 80 minute acetylation at 95° C., DP of Weyerhaeuser Peach® pulp was 520, 10 wt. % total cellulose in solution, 95° C.

Sample 58: acetic acid added with anhydride at 100 wt. % of pulp to decrease viscosity and increase end solubility.

Sample 61: EMIMCl/NMP (N-methylpyrrolidone) mixed solvent used at 70/30 w/w, NMP added after anhydride at 100 wt. % of pulp to decrease viscosity.

Films from cellulose esters and their blends were prepared to test their mechanical properties. The results are summarized in Tables 5 and 6.

TABLE 5

Mechanical properties of the cellulose ester films with high hemicellulose content.

| Film | Elongation (%) | Modulus (GPa) | Tensile (MPa) | DS (C2) | DS (C6) |
|---|---|---|---|---|---|
| CA lab (from table 3) | 2.4 | 1 | 36 | 2.6 | 0 |
| CAH lab (from table 3) | 12 | 1.3 | 42 | 0.96 | 0.21 |

Lab CAH films have much higher elongation than CA films.

TABLE 6

Thermal and mechanical properties of cellulose ester blend films.

| Polymer | Strength (MPa) (yield) | Elongation (%) (break) | Modulus (GPa) | Tg (DSC)(° C.) |
|---|---|---|---|---|
| CA (from table 3)/ 14% PMMA-BMA | 54 | 10 | 1.9 | 176 |
| CA (from table 3)/ 8% PMMA-EA | 57 | 13 | 1.8 | 170 |

Additional notes on Table 6:

PMMA-BMA is poly(methyl methacrylate co butyl methacrylate).

PMMA-EA is poly(methyl methacrylate co ethylacrylate).

Cellulose acetate has Tg from 189 to 193° C.

Polymeric blending enhanced CA film elongation (comparing films in Table 6 with those in the Table 5) and lowered Tg. With glucose pentaacetate or triethyl citrate as plasticizer, the polymer blends will have lower Tg.

Example 16: Injection Molded Articles Formed from Representative Cellulose Esters In this example, the preparation of injection molded articles from representative cellulose esters of the invention are described.

Pellets were made from high hemicellulose containing cellulose mixed esters CAH using a Haake mini-extruder. The process temperatures range between 245 and 255° C. A Haake mini-jet injection molding machine was used to make injection molding for testing.

The mechanical properties of cellulose ester articles prepared by injection molding are summarized in Table 7.

TABLE 7

Mechanical properties of injection molded cellulose ester articles.

| Sample | Tensile strength (MPa) | Elongation at break (%) | Modulus (GPa) |
|---|---|---|---|
| Commercial CA | 55.8 | 1.6 | 3.9 |
| Plasticized commercial CA (20% triethyl citrate as plasticizer) | 57.3 | 7.1 | 2.8 |
| Lab mixed ester CAH from table 5. DSs and DSI: DS for C2 and C6 chains | | | |
| DSs, DSI (1.23, 0.27) | 76.5 | 7.1 | 2.8 |

Mixed ester CAH without any plasticizer has similar performance as commercial CA with fugitive plasticizer. Injection molded bars from cellulose mixed esters CAH have higher tensile, elongation, much better color, lower modulus than the bars from pure commercial cellulose acetate. The mixed ester CAH has higher processing temperature and higher mechanical strength than plasticized commercial CA.

The improvement of properties of the mixed ester is related to the long carbon chains incorporated into the cellulose on esterification with higher alkyl anhydrides. The greater the long chain content, the greater the tensile and elongation, and the lower the modulus.

Example 17: Determination of Sulfur Content for Representative Cellulose Esters

In this example, the sulfur content of representative cellulose esters of the invention is described. Sulfur content was determined using ASTM D1552. The results are summarized in Table 8.

TABLE 8

Sulfur Content of Cellulose Esters (ASTM D1552)

| Cellulose ester samples | Sulfur (ppm) |
|---|---|
| Cellulose acetate from Aldrich (catalog #: 419028), 39.7 wt % acetyl content | 47 |
| Cellulose acetate propionate from Aldrich (catalog #: 454907) | 79 |
| Cellulose acetate butyrate from Aldrich (catalog #: 419060), >49 wt % butyral content | 55 |
| Sample 1 in table 1 | 150 |
| Sample 4 in table 1 | 31 |
| Sample 8 in table 1 | 42 |
| Sample 22 in table 1 | 30 |
| Sample 58 in table 4 | 29 |

| | Esterification condition | | | Dissolution | | Esterification | | |
|---|---|---|---|---|---|---|---|---|
| Sample | Additive | AA/AGU (mol ratio) | Solvent | Temp (° C.) | Time (hr) | Addition (min) | Reaction (hr) | Sulfur (ppm) |
| 62 | C6/AGU (1.1) | 2.1 | EMIMCl | 95 | 6 | 15 | 0.75 | 58 |
| 63 | C6/AGU (1.1) | 2.1 | EMIMCl | 95 | 6 | 15 | 0.75 | 160 |

Additional notes on Table 8:

Sample 58: acetic acid (100% wt % on pulp, pulp DP about 520) was added after pulp dissolution and before anhydride addition to decrease viscosity and increase ester solubility. Catalyst DMAP added at 5 wt % on pulp. Lower viscosity ester dope promoted washing.

Sample 62: same as sample 58 except solvent EMIMCl was used and no cosolvent acetic acid was added.

Sample 63: same as sample 62 except catalyst DPTS (4-(dimethylamino)pyridinium 4-toluenesulfonate) at 2 wt %, instead of 5 wt % DMAP on pulp was used. Because the catalyst contains sulfur, the final product with regular washing (water wash at room temperature) had high sulfur.

Adding a cosolvent such as acetic acid can decrease ester dope viscosity promoting washing and sulfur, nitrogen content reduction. Intensive washing with water and other solvents can promote sulfur, nitrogen reduction. In these samples, sulfur was not chemically bonded with the cellulose ester like in conventional process with sulfuric acid as catalyst, so it is possible to use simple was to remove most sulfur. The same is true for nitrogen removal although some nitrogen containing ionic liquid may react with cellulose.

While illustrative embodiments have been illustrated and described, it will be appreciated that various changes can be made therein without departing from the spirit and scope of the invention.

We claim:

1. A method of making an esterified cellulose pulp composition, comprising:

(a) combining an ionic liquid and a cellulose pulp to provide a cellulose solution, wherein the cellulose pulp has an alpha cellulose content from 70 to 90 wt %, a hemicellulose content from about 5 to about 20% by weight, and a degree of polymerization from about 150 to about 1,000;

(b) adding an esterification agent, optionally a catalyst to the cellulose solution to provide a reaction mixture; and (c) isolating the esterified cellulose pulp composition from the reaction mixture;

wherein the esterified cellulose pulp composition has a degree of substitution from about 0.1 to about 3.0, a sulfur content less than about 45 ppm, and a nitrogen content less than about 0.2% by weight based on the total weight of the composition.

2. The method of claim 1, wherein isolating the esterified cellulose pulp composition comprises precipitating, and one or more of pulsing, blending, and grinding the precipitated esterified cellulose pulp composition in washing liquids; washing the esterified cellulose pulp composition; optionally bleaching the esterified cellulose pulp composition; further washing the esterified cellulose pulp composition; and drying the esterified cellulose composition.

3. The method of claim 1, wherein the ionic liquid is selected from the group consisting of 1-allyl-3-methylimidazolium chloride ("AMIMCl"), 1-butyl-3-methylimidazole chloride ("BMIMCl"), 1-ethyl-3-methylimidazole chloride ("EMIMCl"), 1-ethyl-3-methylimidazole acetate ("EMIMAc"), 1-ethyl-3-methylimidazolium dicyanamide, N-methyl-N-methylimidazolium dimethyl phosphate, 1-butyl-3-methylimidazolium dimethylphosphate, tetramethylguanidine formate, tetramethylguanidine acetate, tetramethylguanidine propionate, 1,5-diaza-bicyclo[4.3.0]non-5-enium propionate, 1,8-diaza-bicyclo[5.4.0]undec-7-enium propionate, butymethylimidazolium-cyclohexyl carboxylate, quaternary ammonium hydroxides, and mixtures thereof.

4. The method of claim 1, wherein the cellulose solution further comprises a co-solvent.

5. The method of claim 4, wherein the co-solvent is N-methylpyrrolidone, ("NMP"), dimethyl acetate ("DMAc"), dimethylformamide ("DMF"), dimethyl sulfoxide ("DMSO"), acetic acid, or mixtures thereof.

6. The method of claim 1 further comprising heating the reaction mixture to a temperature of from 20° C. to about 180° C. after step (b) and before step (c).

7. The method of claim 6, wherein the reaction mixture is heated for a duration of from 0.2 hour to 20 hours.

8. The method of claim 1, wherein the ionic liquid is heated to a temperature of from 20° C. to 180° C. prior to combining with the cellulose pulp.

9. The method of claim 1 wherein the esterification agent is an anhydride.

10. The method of claim 1, wherein the esterification agent is an anhydride having the formula: $R^1$—C(═O)OC(═O)—$R^2$, wherein $R^1$ and $R^2$ are independently selected from $C_{1-12}$ alkyl.

11. The method of claim 1 further comprising adding an esterification catalyst to the cellulose solution.

12. The method of claim 11, wherein the esterification catalyst is selected from the group consisting of dimethylaminopyridine ("DMAP"), iodine, tosyl chloride, carbonyldiimidazole ("CDI"), dicyclohexylcarbodiimide ("DCC"), trifluoroacetic anhydride ("TFAA"), organic titanium (IV) compounds, sulfonic acid resin, ytterbium (III) triflate ("YE"), vanadyl acetate ("VAc"), gadolinium triflate, scandium (III) triflate, triethylamine, and mixtures thereof.

13. The method of claim 1, wherein the esterified cellulose pulp composition has a hemicellulose content from 2.5 to 20 percent by weight based on the total weight of the composition.

14. A method of making an esterified cellulose pulp composition, comprising:

(a) combining an ionic liquid and a cellulose pulp to provide a cellulose solution;

(b) adding an esterification agent to the cellulose solution to provide a reaction mixture; and (c) isolating from the reaction mixture an esterified cellulose pulp composition having a degree of substitution from about 0.1 to about 3.0, a hemicellulose content from about 2.5 to about 20 percent by weight based on the total weight of the composition, and an intrinsic viscosity from 0.7 to 3.0 dL/g.

15. A method of making an esterified cellulose pulp composition, comprising:

(a) combining an ionic liquid and a cellulose pulp to provide a cellulose solution;

(b) adding an esterification agent to the cellulose solution to provide a reaction mixture; and (c) isolating from the reaction mixture a C2 to C12 alkyl esterified cellulose pulp composition having a degree of substitution from about 2.0 to about 2.5, a hemicellulose content from about 3.5 to about 10 percent by weight based on the total weight of the composition, and an intrinsic viscosity from 0.7 to 3.0 dL/g.

* * * * *